US005174607A

United States Patent [19]

Hill

[11] Patent Number: 5,174,607

[45] Date of Patent: Dec. 29, 1992

[54] REMOVABLE CLIPBOARD ARRANGEMENT

[76] Inventor: David E. Hill, 633 S. Hickory, Gardner, Kans. 66030

[21] Appl. No.: 803,342

[22] Filed: Dec. 4, 1991

[51] Int. Cl.[5] ..... B42D 3/00

[52] U.S. Cl. ..... 281/45; 281/44; 40/405; 206/414; 224/277

[58] Field of Search ..... 281/44, 45, 13; 40/371, 40/405; 206/414, 425; 224/277

[56] References Cited

U.S. PATENT DOCUMENTS

| | | | |
|---|---|---|---|
| 2,678,833 | 5/1954 | Loeb | 281/44 |
| 2,770,472 | 11/1956 | Whitwell | 281/44 |
| 5,025,919 | 6/1991 | Brinker et al. | 281/15.1 |
| 5,056,822 | 10/1991 | Shim | 281/44 |

OTHER PUBLICATIONS

Jiffy Lube Attachable Clipboard, see photograph #1.
Auto Attache Clipboard, see photographs #2 and #3.
Deluxe Auto Clipboard, see photograph #4.

*Primary Examiner*—Timothy V. Eley
*Assistant Examiner*—Willmon Fridie, Jr.
*Attorney, Agent, or Firm*—Wm. Bruce Day

[57] ABSTRACT

A clipboard arrangement includes a planar base member having a raised peripheral rim and a suction cup mounting plate hingedly mounted to a top edge of the base member. A removable clipboard assembly is selectively mounted to the planar base member and has a clamp plate at its upper edge for mounting a writing pad upon the clipboard. A bottom bracket extends outwardly from the base member to cradle and hold the clipboard bottom edge and a tang and slot juncture extends between the clipboard and the planar base member toward upper portions of the clipboard and base member so that a clipboard can be easily lifted slightly upwardly and then outwardly from the base member for carrying. Use of the clipboard arrangement permits the user to semi-permanently mount the planar base member to a suitable surface within a vehicle, such as a windshield or dashboard and then to easily remove the clipboard when going about his or her business, such as shopping or running errands.

2 Claims, 2 Drawing Sheets

REMOVABLE CLIPBOARD ARRANGEMENT

FIELD OF THE INVENTION

The present invention relates to clipboards in general and particularly to such clipboards which can be removably connected, such as by suction cups, to automobile windshields.

BACKGROUND OF THE INVENTION

Small clipboard arrangements particularly suited for automobile or light truck usage have become popular in recent years and are generally provided as low cost or giveaway type items by companies associated with vehicular businesses, such as gasoline stations, truck stops, quick change lubrication centers and the like. Known in the prior art are clipboards which are hingedly mounted on plates which carry one or more suction cups so that the device can be connected by the suction cups to an automobile windshield or other parts of the automobile glass. Normally, these clipboards are small in size and are made to accommodate note pad size tablets, such as of three by five inch or four by six inch tablets.

There have been various adaptations on the above-described structure including battery powered lights mounted in the clamp arrangement so that the notepad is illuminated for night use, pencil or pen holders, including velcro fastened pencil and pen holders, covers that swing over the tablet and various lever operated cam devices that permit the suction cups of the clipboard to be easily released from the automobile window so that the clipboard can be easily removed and taken with the user. Even then, the user takes into the store, a lumber yard, grocery store or the like, a clipboard object that is not easily storable in one's pocket or purse, but has outwardly projecting suction cups which makes the device less useful.

SUMMARY OF THE INVENTION

The present invention is designed to alleviate the difficulties encountered in the use of the aforementioned prior art clipboard arrangements by providing a clipboard arrangement which is constructed in separable parts, one of which stays in the vehicle and the other of which is a clipboard that can be taken with the user and used in grocery stores, lumber yards or other shopping areas, or where, for example, notations need to be made by people who work both inside of the vehicle and outside of the vehicle. The disclosed invention provides a planar base member which has a raised peripheral rim and has suction cups on a plate hingedly mounted to a top edge of the base member so that the suction cups and the base member are removably secured to the vehicle by the suction cups. A clipboard is removably mounted to the base member and has a clamp plate biased to a downward clamping position and that holds a note tablet of selected size. Brackets extend between the clipboard and the base member creating easy removal and replacement of the clipboard relative to the base member, and therefore the clipboard can be used inside of the vehicle and readily taken with the user as he or she departs the vehicle. The clipboard does not contain extending suction cups or other protuberances, making it compact and easy to use.

Accordingly, the objects of the present invention are: to provide a clipboard arrangement which removably mounts inside of a vehicle; to provide such a clipboard arrangement which includes separate clipboard and base mount portions which can be manipultated so that the base is attractively designed and can be inexpensively made; and to provide such a clipboard arrangement which is well designed for the intended purpose.

Other objects and advantages of this invention will become apparent from the following description which, taken in connection with the drawings demonstrate a preferred embodiment of the invention.

DESCRIPTION OF THE PREFERRED EMBODIMENT

As required, a detailed embodiment of the present invention is disclosed herein. It is, however, to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
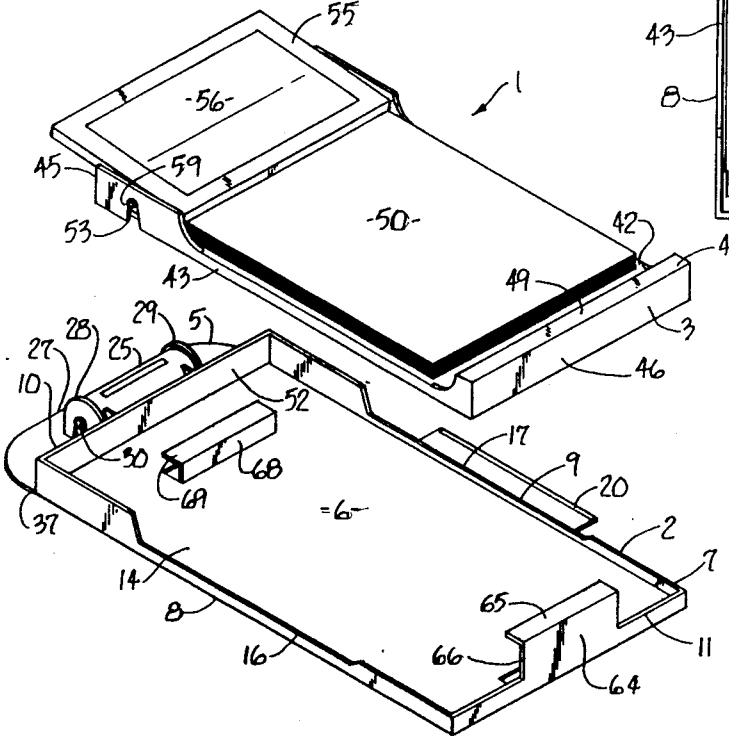
FIG. 1 is a prospective view of a arrangement embodying the present invention shown with the clipboard lifted off.

The reference numeral 1, FIG. 1, designates a clipboard arrangement embodying the present invention and shown with a base member 2 separated from a clipboard 3. A suction cup mount 5 is hingedly connected to a top edge of the base member 2, permitting the base member 2 to be removably secured to the interior of the vehicle and the clipboard 3 removed from the base member when it is desired to use the clipboard 3 outside of the vehicle.

In more detail, the base member 2, FIG. 1 has a planar section 6 with a raised peripheral rim 7, opposite sides 8 and 9 and top and bottom edges 10 and 11. Additionally, the base member 2 has a front side 14 and a back side 15. The raised peripheral rim 7 is highest along the top edge 10 and has mid-areas 16 and 17 which are lowest, thereby providing ease of fingertip access to any tablet mounted on the clipboard 3 as hereinafter described.

Figure 3:
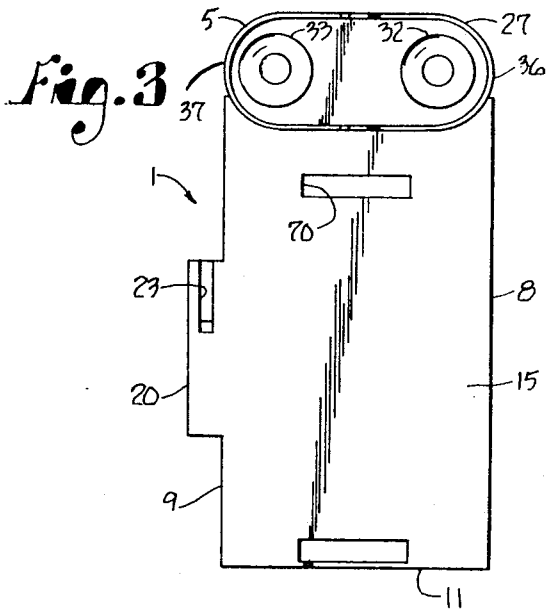
FIG. 3 is a bottom plan view of the clipboard and the base.
Figure 2:
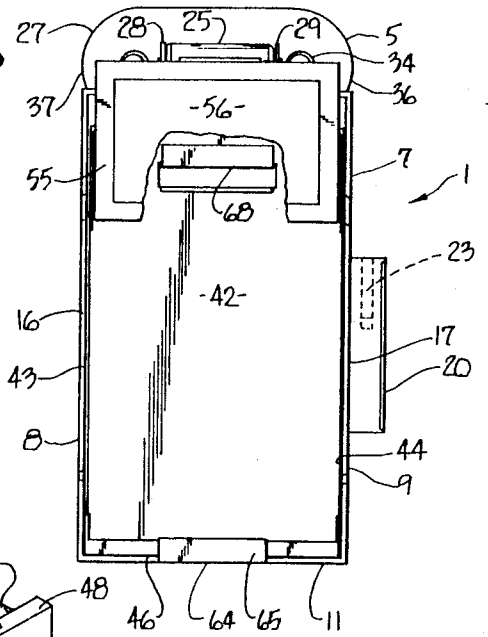
FIG. 2 is a top plan view of the clipboard and a base mountable such as to the windshield.
Figure 4:
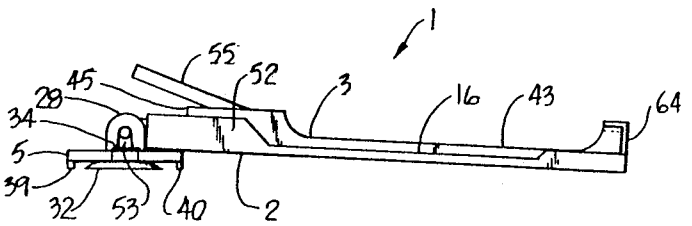
FIG. 4 is a side elevational view of the clipboard arrangement.

An elongate tab 20 extends parallel to- and outwardly of the side 9 for receiving a clip 21 of a writing instrument 22. A recess 23 for the clip, FIGS. 2 and 3, helps insure connection. As shown in FIG. 3, the recess 23 extends into the backside of the tab 20.

Figure 7:
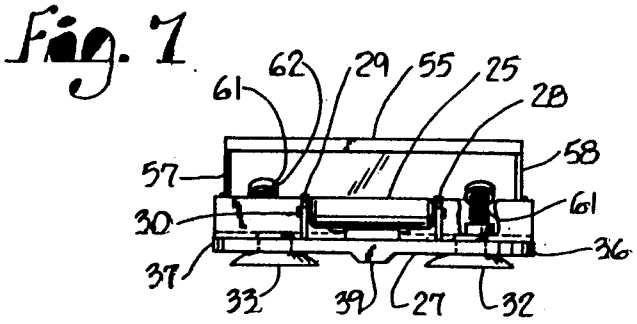
FIG. 7 is an end elevational view of the clipboard arrangement.

Hinge means extend from the top edge 10 of the base member 2 and connect to the suction cup mount 5. In the illustrated example, the hinge means includes a tube portion 25, FIG. 7, with aligned through bores, (not shown). The suction cup mount 5 includes an elongate, generally oval plate member 27 to which spaced, upstanding ears 28 and 29 are affixed. The ears 28 and 29 are spaced apart a sufficient distance to accommodate the tube portion 25 therebetween. A hinge pin 30 extends through aligned holes in the ears 28 and 29 and the tube portion 25 to hingedly connect the plate member 27 to the base member 2.

In the illustrated example, the plate member 27 has two suction cups 32 and 33 attached thereto and which are preferably of a long lasting pliant synthetic rubber, such as a silicone impregnated rubber. The suction cups 32 and 33 respectively have knob heads 34 which are extended through mounting holes (not shown) through the plate member 27. Further, the sur cups 32 and 33 are mounted adjacent opposite ends 36 and 37 of the plate member 27. Short legs 39 and 40 extend downwardly from midpoints of the plate member 27 and limit any rocking member of the plate member 27 which could pull the suction cups 32 and 33 loose.

The clipboard 3 also includes a planar section 42 and has opposite sides 43 and 44 and top and bottom edges 45 and 46. A raised rim 48 at the bottom edge 46 provides a nesting place for bottom edges of tablets 50, FIG. 1, which may be clipped to the clipboard 3. The raised rim 48 has a top edge surface 49 which engages a portion of the connection means extending between the base member 2 and clipboard 3 as hereinafter described. A top raised rim 52 extends around the top edge 45 and downwardly along a portion of the sides 43 and 44 and provides hinge pin holes 53. A clamp means is hingedly mounted adjacent the top edge surface 4 and has a broad flat plate portion 55 providing a suitable handhold for pressing and which has a suitable area for affixing an advertising logo 56. Spaced ears 57 and 58, FIG. 7, extend downwardly toward the top raised rim 52 and connect through to hinge pins 59, FIG. 1, respectively protruding from the ears 57 and 58 to hingedly connect the plate portion 55 to the clipboard 3. Springs 61, such as coil springs, are received in bosses 62 and spring bias the plate portion 55 to a downwardly swung position to hold tablets 50 on the clipboard 3.

Figure 6:
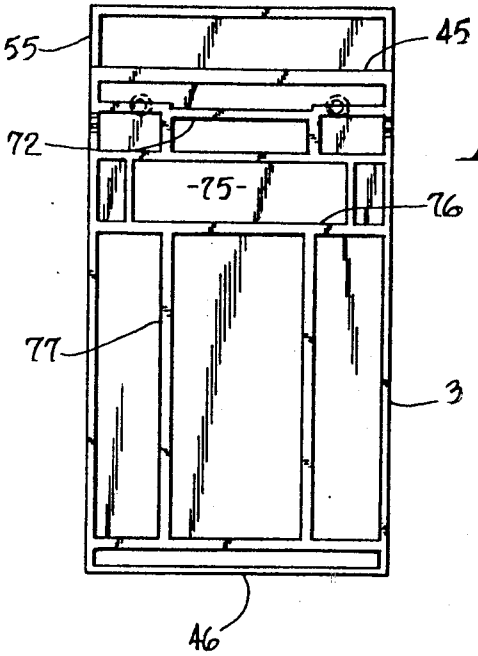
FIG. 6 is a elevational view of the clipboard arrangement and shown separated from the base portion.
Figure 5:
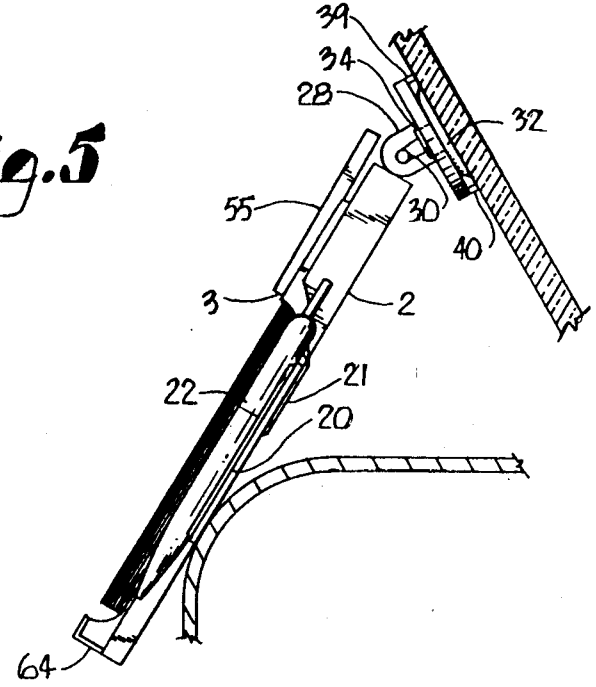
FIG. 5 is a side elevational view of the clipboard arrangement mounted on a surface such as a windshield.

Means extend between the base member 2 and clipboard 3 in order to removably mount the clipboard to the base member. In the illustrated example, the means include a bottom bracket 64 outstanding from the bottom edge 11, having a top flange 65 and forming a channel 66 for receipt and cradling the clipboard bottom edge 46 so that the raised rim 48 and top edge surface 49 is securely received within the channel 66. Additionally, a slot and tang juncture extend between the planar base member 2 and the clipboard 3 generally at upper portions of the base member 2 and clipboard 3. In the illustrated example, a top bracket 68 extends upwardly from the base member planar section 6 and is generally in the shape of an L with an upwardly extending leg or tang 69. To aid in formation of the device, as by molding, a cutout 70, FIG. 3, is provided. The top bracket 68 fits within a slot 72, FIG. 6, so that the clipboard 3 hangs by the top bracket 68 and with its bottom edge 46 received within the bottom bracket 64.

To provide additional usefulness, a strip magnet 75 is mounted within a recess 76 on a back side of the clipboard 3 so that the clipboard 3 can be selectively attached to a magnetic surface, such as a refrigerator door, when not mounted upon the base member 2. Other strengthening ribs 77 on the backside of the clipboard 3 provide a rigidity to the plastic structure.

Preferably, the entire structure, with the exception of metal hinge pins and coil springs is formed of molded plastic parts for ease of manufacture and to keep costs as low as possible.

Although one form of this embodiment has been illustrated and described as shown, it is not to be limited to the preferred embodiment as shown herein except insofar as set forth in the following claims.

What is claimed and desired to be secured by Letters Patent is as follows:

1. A clipboard arrangement comprising:

a) a planar base member having a raised peripheral rim and with opposite sides and top and bottom edges;

b) an elongate tab extending parallel to one of said sides for receiving a clip of a writing instrument;

c) hinge means extending from said top edge;

d) an elongate plate member connected to said hinge means and extending parallel to said top edge and having opposite ends;

e) spaced suction cups mounted on said plate member and respectively positioned adjacent said. opposite ends for gripping and removably connecting said planar base member to a grippable surface;

f) a clipboard removably connectible to said planar base member and resting within said raised peripheral rim, said clipboard being a planar member with opposite sides and top and bottom edges and having a raised shelf portion extending outward from said bottom edge and a clamp means at said top edge;

g) said clamp means having a clamp plate with hinge pins connected to said clipboard planar member and spring means biasing said clamp plate to a downward clamping position for mounting a writing pad upon said clipboard; and h) means removably mounting said clipboard to said planar base member and including a bottom bracket extending outwardly from said planar base member and cradling said clipboard raised shelf portion and a slot and tang juncture extending between said planar base member and said clipboard whereby said clipboard is easily removable from said planar base member.

2. A clipboard arrangement comprising:

a) a planar base member having a mounting means, a raised peripheral rim and with opposite sides and top and bottom edges, said mounting means having at least one suction cup for gripping and removably connecting said planar base member to a grippable surface;

b) a clipboard removably connectible to said planar base member and resting within said raised peripheral rim, said clipboard being a planar member with opposite sides and top and bottom edges that are spaced apart, and having a raised shelf extending outwardly form said clipboard bottom edge and a clamp means at said clipboard top edge, said clamp means having a clamp plate and means biasing said clamp plate to a downward clamping position for mounting a writing pad upon said clipboard; and c) means removably mounting said clipboard to said planar base member and including a bottom bracket extending outwardly from said planar base member and cradling said clipboard for easy lift out removability from said planar base member.

* * * * *